United States Patent [19]

Trojanowski

[11] Patent Number: 4,795,361

[45] Date of Patent: Jan. 3, 1989

[54] CLAMPING APPARATUS FOR COUPLING WAVEGUIDES TO ONE ANOTHER

[75] Inventor: Norbert T. Trojanowski, Glen Ridge, N.J.

[73] Assignee: ITT Avionics, A Division of ITT Corporation, Nutley, N.J.

[21] Appl. No.: 39,398

[22] Filed: Apr. 17, 1987

[51] Int. Cl.[4] ..... H01R 13/62

[52] U.S. Cl. ..... 439/368; 439/370; 439/372; 439/920

[58] Field of Search ..... 439/296, 345, 359, 362, 439/368, 370, 373, 920

[56] References Cited

U.S. PATENT DOCUMENTS

| | | | |
|---|---|---|---|
| 2,266,560 | 12/1941 | Mansfield | 439/368 |
| 3,431,537 | 3/1969 | Klingenberg | 439/368 |
| 4,105,274 | 8/1978 | Casey | 439/373 |
| 4,253,720 | 3/1981 | Crosier | 439/362 |

FOREIGN PATENT DOCUMENTS

| | | | |
|---|---|---|---|
| 715611 | 1/1942 | Fed. Rep. of Germany | 439/373 |
| 657492 | 4/1979 | U.S.S.R. | 439/362 |

*Primary Examiner*—John McQuade

*Attorney, Agent, or Firm*—Robert A. Walsh; Thomas N. Twomey; Mary C. Werner

[57] ABSTRACT

There is disclosed a clamping device which comprises a U-shaped spring secured to a spring retainer in a pivotable manner. The spring retainer is a sub-assembly which consists of two plates forming a slot when sandwiched together to accommodate the spring. The two plates associated with the retainer assembly accommodate a rotatable bolt or screw which screw is directed into a compression stop assembly. A bracket is mounted to the appropriate waveguide flange. This bracket contains an aperture to accommodate a projecting end of the spring. The mating waveguide flanges are clamped in place by adjusting the captive screw which serves to deflect the U-spring completing the clamping action. The unit, as described in the specification, contains two U-shaped springs both of which are coupled to a central spring retaining unit and can operate to connect or disconnect two separate waveguide sections.

20 Claims, 4 Drawing Sheets

CLAMPING APPARATUS FOR COUPLING WAVEGUIDES TO ONE ANOTHER

The Government has rights in this invention pursuant to Contract No. N00019-81-C-0369 awarded by the Department of the Navy.

BACKGROUND

This invention relates to clamping assemblies and more particularly to a waveguide clamp assembly which employs a quick disconnect operation.

As is known in the prior art, waveguides are widely employed to enable the transmission of high frequency signals such as those signals employed in the microwave range. As such waveguides are employed in many systems as communications system, radar systems and various other systems which require high frequency or microwave operation. Waveguides are employed, for example, in many situations where space is extremely limited, such as on aircraft or on other vehicles which would utilize radar or other systems employing microwave transmissions. As such, a waveguide is a typical and well-known component and usually consists of a hollow member of a circular or rectangular cross section, which member is of a predetermined length and which member usually terminates in a flange. As such, waveguide sections must be coupled together. In any event, they must be coupled together and removed in order to provide suitable maintenance. Prior art techniques for coupling the waveguides together employed screws, bolts and other conventional fastening means which coacted with the terminating flanges. Such connections were relatively permanent and where space was limited it became extremely difficult to disconnect or disassemble connected waveguide assemblies in order to service or maintain the equipment. The prior art cognizant of such problems provided different clamp structures, most of which are difficult to operate and complicated. As one can ascertain, in order to provide good connections between different waveguide sections, one must be assured that the flanges of the waveguides abut in a efficient manner to prevent signal leakage as well as providing a secure mechanical connection.

In order to obtain additional information concerning waveguides and their uses, reference is made to a text entitled "Reference Data For Radio Engineers", published by Howard W. Sams & Company, Inc., a subsidiary of ITT Corporation, the assignee herein (1977) Chapter 25, entitled *Waveguides and Resonators.* In any event, as indicated above, there is an extreme problem in providing clamp assemblies which will enable one to selectively connect and disconnect waveguides in a rapid and efficient manner. This is particularly troublesome where the space is limited, such as the space provided on an aircraft or other vehicle, or space provided in an extremely compact location. In such conditions it is desirable to provide a clamp assembly which will enable one to couple two waveguide sections together and to assure a guide disconnected, while further assuring that the coupling is efficient in that there is a minimal signal leakage.

It is a further object to provide a clamping assembly which allows one to firmly connect two waveguide assemblies together in one position and to disconnect the same waveguide assemblies when the clamp is operated in a second position.

BRIEF SUMMARY OF THE INVENTION

A waveguide clamping apparatus for clamping a first waveguide flange to a second waveguide flange, comprising a housing having an aperture adapted to receive a rotatable threaded member, with said housing secured to the backside of sais first waveguide flange and said housing extending along said flanges when said flanges are abutting one against the other; a spring retainer clamp assembly having a spring accommodating cavity and having an aperture aligned with said housing aperture; a rotatable threaded member positioned in said aligned apertures and operative when rotated to move said clamp assembly towards or away from said housing; a U-shaped spring member having said base positioned in said spring accommodating cavity to allow said member to pivot, with the arms of said member directed towards the top and bottom back surfaces of said second waveguide flange; and a U-shaped retainer clip having the base secured to said back surface of said first waveguide flange with the arms directed above and below said abutting flanges and having means adapted to coact with the arms of said associated spring member for clamping said guides in abutment when said clamp assembly is moved towards said housing and to allow said guides to be separated when said clamp assembly is moved away from said housing.

BRIEF DESCRIPTIONS OF FIGURES

DETAILED DESCRIPTION OF INVENTION

Figure 1:
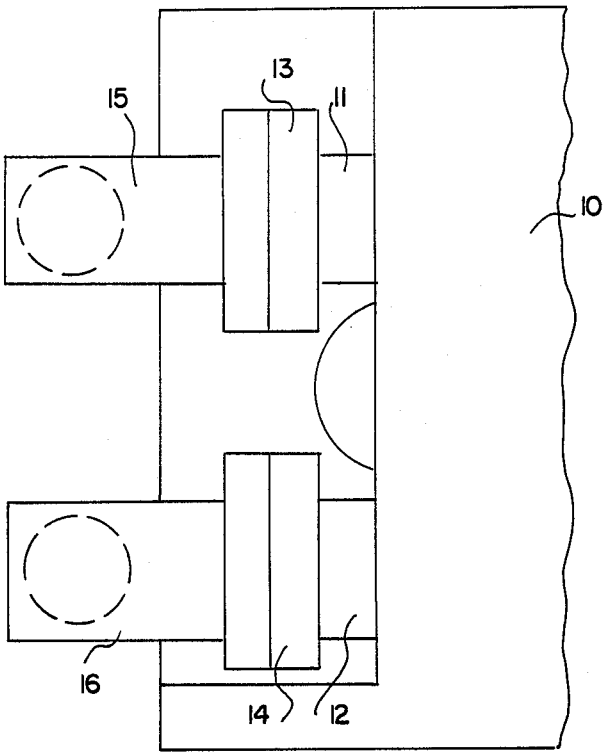
FIG. 1 is a top plan view showing a waveguide assembly employing input and output waveguides which are to be coupled to return waveguides.

Referring to FIG. 1 there is shown a typical microwave assembly 10 which may be employed on an aircraft. Essentially the assembly 10 may comprise a radar system housing or some other microwave apparatus which may be incorporated on an aircraft or other vehicle. As seen from FIG. 1 the assembly 10 has two output waveguides 11 and 12, each of which is terminated in a waveguide flange. The waveguides 11 and 12 are typically terminated in output flanges 13 and 14. As seen from FIG. 1 there are two auxiliary waveguides, namely 15 and 16, which are coupled to waveguides 13 and 14 and are positioned so that their flanges abut as shown in FIG. 1. The waveguides 15 and 16 may have bends and, as shown by the dashed circles, are directed downwardly or in some other direction. In any event, one has to provide an effective means of coupling the flanges of waveguides 15 and 16 to the flanges of waveguides 13 and 14 in order to assure a good mechanical seal, as well as a good electrical seal. As explained above, the flanges of the waveguides must abut rather securely, one to the other, in order to enable efficient microwave propagation while providing a good mechanical coupling.

Figure 2:
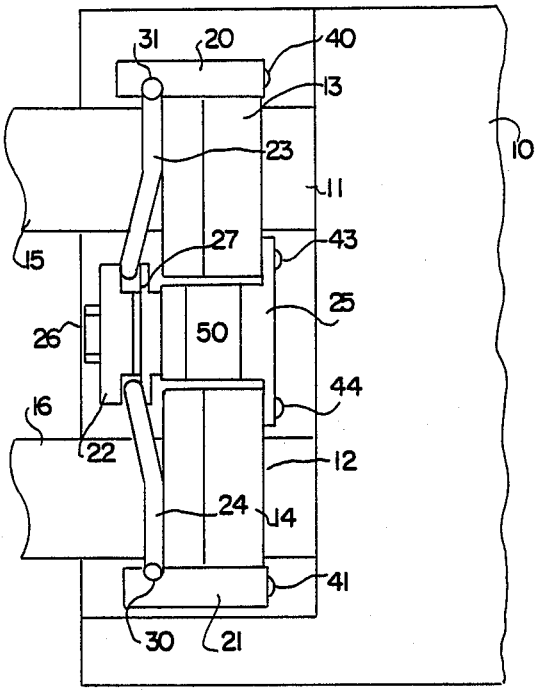
FIG. 2 is a top plan view of a clamping mechanism coupled to appropriate waveguide sections.
Figure 3:
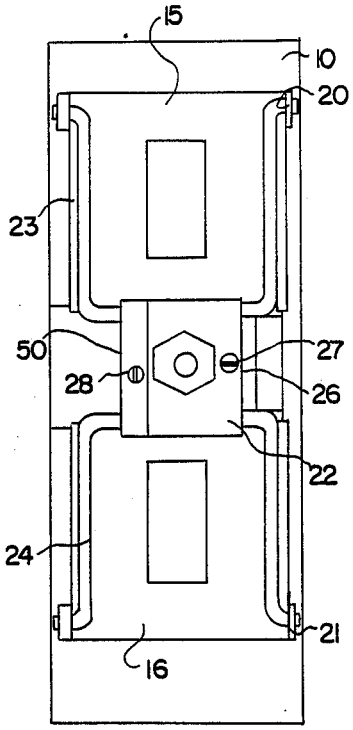
FIG. 3 is a side view of the clamping mechanism of FIG. 2.

Referring to FIG. 2 there is shown a top plan view, similar to FIG. 1, showing a clamp mechanism 50 according to this invention. Essentially, as seen from FIG. 2, the flanges associated with waveguides 13 and 14 each accommodate an end spring retainer bracket or clip designated as 20 and 21. Each bracket 20 and 21 is secured to the flanges of waveguide members 13 and 14 by means of suitable screws as 40 and 41 or other fastening devices. Essentially, as will be explained, each of the flanges 20 and 21 are U-shaped members and have relatively symmetrical top and bottom arms. The base of the U clip as 20 is secured to the back surface of the waveguide flange 13 with the arms of the U clip or bracket 21 extending over the top and bottom surface of the abutted waveguides. The top and bottom arms are shown in FIG. 3. Each arm has a semicircular aperture as 31 and 30 which apertures retain the projecting ends of spring members 23 and 24. The spring members 23 and 24 are U-shaped members having an extending projection on both arms of the U, which projections are retained in the apertures as 30 and 31 associated with the end spring retainer brackets 20 and 21. This aspect can best be seen from the side view of FIG. 3 where identical reference numerals have been retained to indicate identical parts.

As seen from FIG. 2, there is a back bracket housing section 25 which is essentially a compression stop housing. The bracket housing 25 is also secured to the back surface of the outer peripheral flanges of waveguide sections 13 and 14 and essentially cooperates with a front spring retainer mechanism or bracket consisting of two parts 22 and 27. As can be seen from FIG. 3, the U-shaped spring members 23 and 24 are pivotally secured to the center spring retainer mechanism 22 and 27 by means of associated slots located therein. The compression stop bracket 25 is coupled to the center spring retainer bracket 22 and 27 by means of a captive bolt 26 which enables one to set the mechanism or to release the mechanism.

As shown in FIG. 2 the entire clamping device 50 is in a position whereby the flanges of waveguides 15 and 16 abut against the flanges 13 and 14 of guides 11 and 12. As one can see, due to the shape of the spring members 23 and 24 which are captured in the slots 30 and 31 of the end spring retainer brackets 20 and 21 there is a uniform force applied to the back surface of the auxiliary waveguide flanges. The distal ends of the arms of the U-shaped springs 23 and 24 are positioned at an angle with respect to the base at the U-shaped member. In this manner the outermost or distal arms of brackets 23 and 24 impinge against the outer surface of the waveguide flange associated with guides 15 and 16 to thereby distribute a uniform force across the flanges thus firmly securing or coupling the waveguide sections together via the flanges. One can see the action from FIG. 2 as well. Each of the spring members are U-shaped members and coact with the corresponding top and bottom apertures as 30 and 31 associated with the end spring retainer clamps 20 and 21. In this manner a uniform force is distributed upon the back surface of the flanges associated with waveguides 15 and 16. By tightening the captive bolt 26, one can adjust the forces imposed upon the flanges to assure maximum mechanical and electrical coupling. As one can see, the captive bolt 26 allows one to achieve a great mechanical advantage while requiring a minimum of space to allow the clamp to generate the necessary high clamping force utilized. Thus, as one rotates the bolt 26 in one direction, the center spring retainer mechanism 22 and 27 moves towards the compression housing 25 to force the springs 22 and 23 against the back surfaces of the waveguide flanges. When the bolt 26 is rotated in the opposite direction the retainer mechanism moves away from the housing 25 thus releasing the springs 23 and 24 (FIG. 5).

As indicated, two pairs of waveguide flanges are clamped together with a single clamping unit. Other commercial products require separate clamps for each pair of flanges which, again, may not be implemented easily in a very confined space. The resulting clamp design fits into the available space without modification of the chassis to which it serves. It is, as seen, totally captive to the chassis, as chassis 10, while assuring an evenly distributed load and is able to accommodate the tolerances that exist in waveguide flange locations. It is also seen from FIG. 2 that the clamp 50 is positioned between the parallel waveguides 11 and 12 and is symmetrical about the clamp center line. However it is understood that the clamping concept depicted can be employed as a single clamp for coupling one waveguide to another via the respective flanges.

Figure 4:
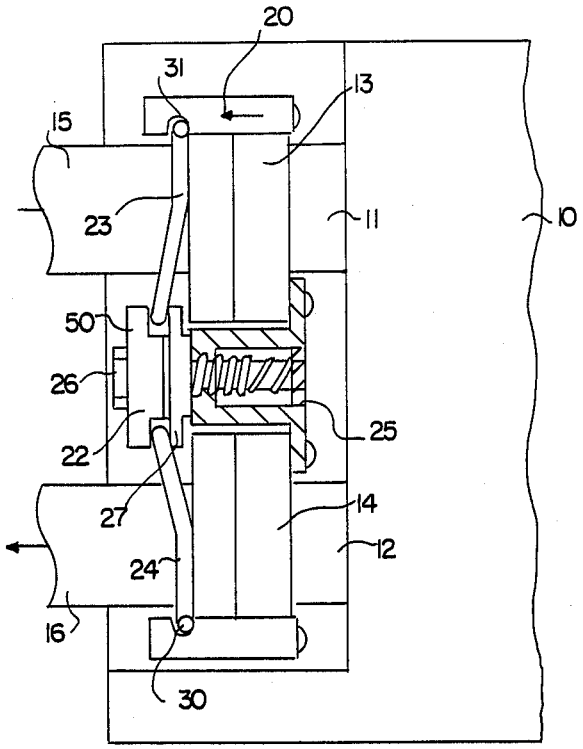
FIG. 4 is a top plan view similar to FIG. 2 depicting a partial cross-sectional view showing the clamping mechanism according to this invention.

Referring to FIG. 4 there is shown a plan view similar to FIG. 2 with a cross-sectional depiction of the compression stop plate 25 showing the captive bolt 26 as well. As one can see from FIG. 4, the captive bolt can be adjusted by rotation within the compression member 25 which it abuts against. In this manner, as one varies the bolt 26 one tends to push the spring members 23 and 24 against the waveguide flanges, thus, continuously assuring adequate force while further assuring a good mechanical and electrical assembly connection.

Figure 5:
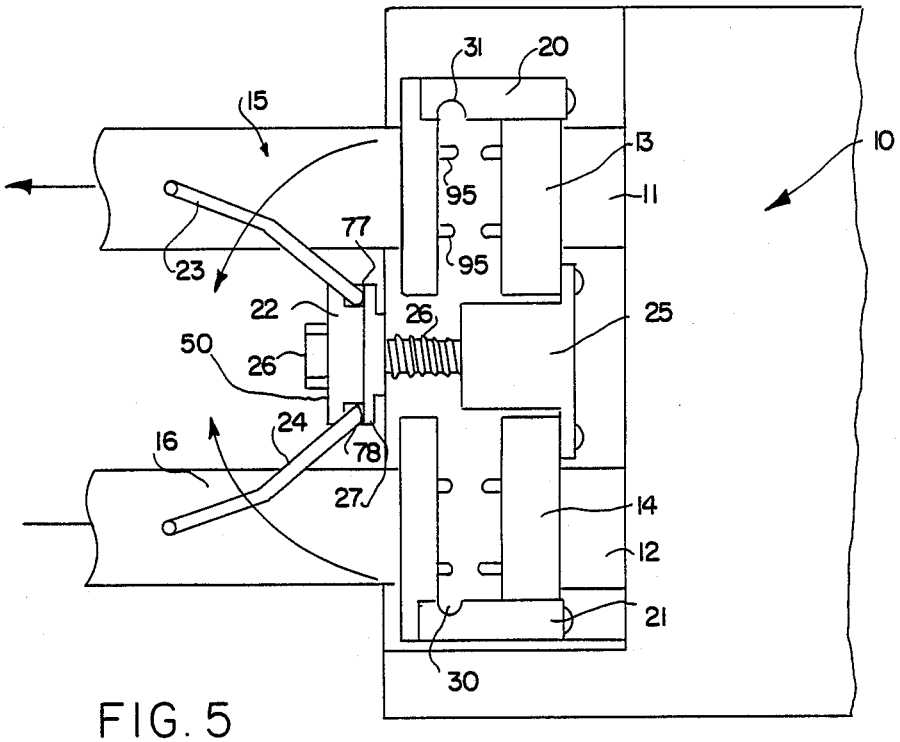
FIG. 5 is a top plan view showing the clamping mechanism in a unclamped position.

Referring to FIG. 5 there is shown the assembly depicted above, again taken from the same view as FIGS. 2 and 4, with the clamping mechanism released. One releases the clamping mechanism by again rotating the captive bolt 26 in regard to the compression member or compression stop member 25. In this manner the spring arms as 23 and 24 are directed out of the semi-apertures 30 and 31 associated with the end spring retainer clamps 20 and 21, thus allowing, by mere rotation of the captive bolt 26, the complete release of waveguides 15 and 16 from the flanges 13 and 14 associated with waveguides 11 and 12.

Figure 7:
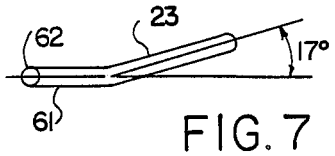
FIGS. 6 and 7 are a front and side view respectively showing a spring assembly of this invention.
Figure 6:
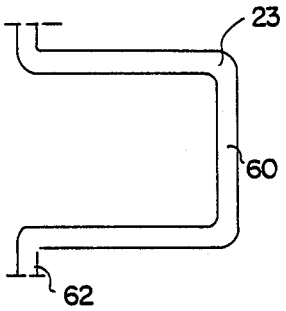

Referring to FIG. 6 and 7 there is shown a side view and a front view of a typical spring device as 23 and 24. It is understood that the clamp assembly described utilizes two such devices. As seen from FIG. 6, and particularly from the top view, there is approximately an angle of 17° which is formed between the distal section of the spring 23 and the common base 60 of the member to enable the surface 61 of the spring assembly to exert a uniform force against the back flange of each associated waveguide section. While the angle of 17° is preferred, angles between 15 and 20° can also be employed. Each spring member as 23 and 24 is of a U-shaped configuration having a common base 60 which is pivotally mounted in a slot formed of the plates 22 and 27 of the spring retainer mechanism. The arms of each spring member have projections 62 at the ends furthest remote from the base 60 which projections are positioned with the apertures 30 and 31 of the end spring retainer clips 20 and 21.

Figure 8:
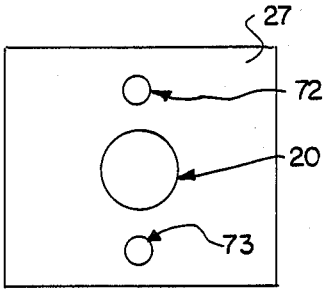
FIGS. 8 and 9 are a bottom and front plan view respectively of the lower portion of the spring retainer clamp assembly employed in this invention.
Figure 9:
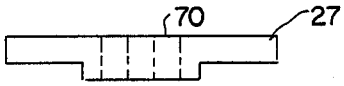
Figure 10:
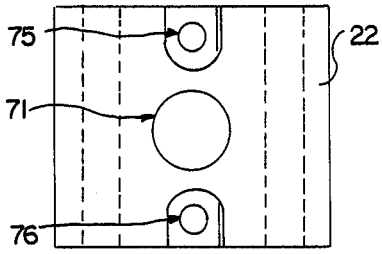
FIGS. 10 and 11 are front and bottom plan views respectively of the upper portion of the spring retainer clamp assembly employed in this invention.
Figure 11:
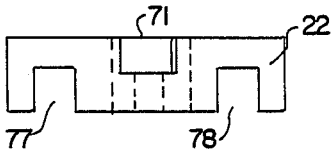

Referring to FIG. 9 there is shown a front view of the spring retainer clamp assembly 27. In FIG. 8 there is shown a bottom view of the same. FIG. 10 shows a front view of the spring retainer clamp assembly section 22 while FIG. 11 shows a bottom view of the same. As one can see, there is a central aperture 70 which aperture in section 27 is aligned with the aperture 71 in section 22 to accommodate the captive bolt 26. The units are secured together by means of screws and bolts located in the apertures 72 and 73 which communicate with apertures 75 and 76 in the associated sections 27 and 22. As can be seen from FIG. 7, the plate 22 and 27 are held together to form two end slots as 77 and 78 (FIG. 4) which slots pivotally accommodate the base as 60 of the U-shaped spring members 23 and 24.

Figure 14:
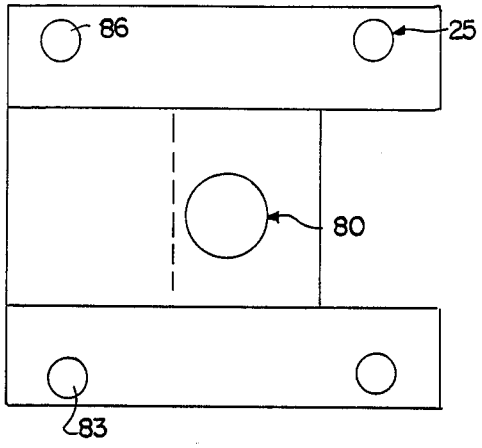
FIGS. 12, 13 and 14 are the front, side and top plan view of the compression stop assembly according to this invention.
Figure 12:
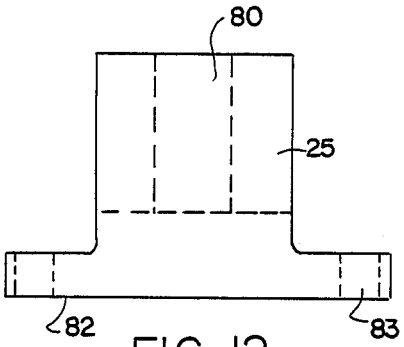
Figure 13:
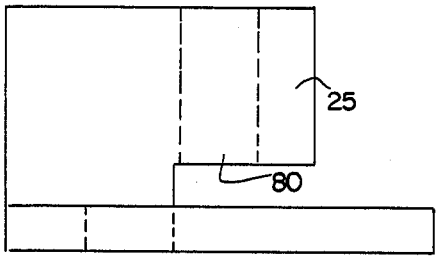

Referring to FIGS. 12, 13 and 14 there is is shown three views depicting the entire assembly for the compression stop bracket 25. As one can see, the aperture 80 is a threaded aperture which is to receive the captive bolt 26 with the brackets depicted in FIG. 12 as brackets 82 and 83 being those brackets which abut against the back surface of the flanges of waveguides 11 and 12. FIGS. 12, 13 and 14 shows the three mechanical views depicting the entire characteristics of the compression stop member 25 as for example shown in FIGS. 2, 3 and so on.

Figure 17:
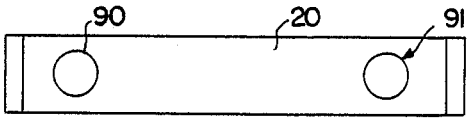
FIGS. 15, 16 and 17 are the side, front and top plan view of the end spring retainer clip assembly according to this invention.
Figure 16:
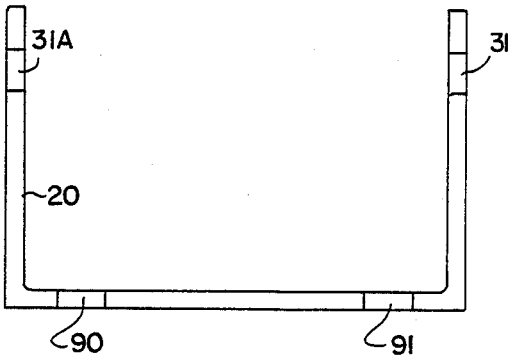
Figure 15:
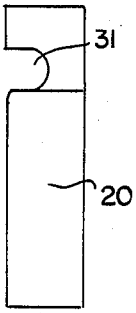

Referring to FIGS. 15, 16 and 17 there is shown the three requisite views which depict the end retainer clamps as for example clamps 20 and 21 as depicted in FIG. 2. As one can see, the clamps are U-shaped clamps having spring retaining apertures as 31 and 31a to retain the projecting portions 62 of the accommodated spring members 23 and 24. There is shown two apertures as 90 and 91 which are utilized to secure the retainer assembles as 20 and 21 to the back side of the flanges as flanges 13 and 14 associated with waveguides 11 and 12. It should thus be clear from the above description, as well as the various mechanical diagrams included herewith, that the entire assembly constitutes an extremely simple design. Essentially, as indicated above, the entire clamping device consists of the two U-shaped springs as springs 23 and 24 which are further depicted in mechanical detail in regard to FIGS. 6 and 7. There is one spring assembly for each pair of flanges which spring assemblies are secured to a common spring retainer mechanism depicted by reference numerals 22 and 27. The spring retainer mechanism is a sub-assembly made up of the two retainer plates such as 22 and 27 shown in FIGS. 8 through 11. This assembly is sandwiched together to captivate the U-spring members. The spring retainer assembly which holds the two springs is then secured to the compression stop member by means of the captive bolt 26. The compression stop member is shown in detail in FIGS. 12 through 14.

Secured to the appropriate flanges of the two waveguides to be coupled to are the brackets which are shown in FIGS. 15 through 17. The brackets, also designated as end spring retainer brackets, are mounted to the waveguide flanges by means of suitable screws. These brackets act as a fulcrum for the U-shaped spring levers as levers 23 and 24. The mating waveguide flanges are clamped in place by rotating the single captive bolts 26 which deflects the U-shaped springs completing the clamping action. One may also employ light compression and torsion springs which are arranged within the spring retainer assembly to enable easier operation in the opening position, thereby facilitating the connection or removal of the mating waveguide flanges.

As can be seen, while the above-noted device accommodates two waveguide sections the same principle can be utilized to couple one waveguide flange to another waveguide flange. The bolt 26 has "quick" or coarse threads to minimize the number of turns required to tighten the assembly. Tightening of the captive bolt 26 on one center spring retainer deflects the springs which results in a nearly equal force along the center line of each flange. The springs are sized to accommodate axial tolerance in the waveguide locations with small force variations. Locating pins the waveguide flange will take up radial tolerances. These locating pins are shown, for example, in FIG. 5 as 95. Removal of the waveguides entails loosening of the captive bolt 26 and center spring retainer mechanism which consists of members 26 and 27 and then swinging the springs clear of the apertures 30 and 31 on the end spring retainer brackets 20 and 21 and which operation is shown and depicted in FIG. 5.

Essentially there is provided a quick disconnect waveguide clamping mechanism which device consists of two springs, one for each waveguide, latched onto spring retainers. The end spring retainers are permanently bolted onto the waveguide flanges. A center spring retainer is bolted onto a compression stop which is also attached to the appropriate waveguide flanges as, for example, shown in FIGS. 2, 4 and 5. From the above-noted description it is indicated that the apparatus provides a waveguide clamping arrangement which assures an extremely quick connect and disconnect operation to enable one to maintain complete alignment of two coupled waveguides while utilizing a minimum amount of space.

What is claimed is:

1. A waveguide clamping apparatus for clamping a first waveguide flange to a second waveguide flange, comprising:

a housing having an aperture adapted to receive a rotatable threaded member, with said housing secured to the backside of said first waveguide flange and said housing extending along said flanges when said flanges are abutting one another;

a spring retainer clamp assembly having a spring accommodating cavity and having an aperture aligned with said housing aperture;

a rotatable threaded member positioned in said aligned apertures and operative when rotated to move said clamp assembly towards or away from said housing;

a U-shaped spring member having a base positioned in said spring accommodating cavity to allow said member to pivot, with the arms of said member directed towards the top and bottom back surfaces of said second waveguide flange; and a U-shaped retainer clip having the base secured to the back surface of said first waveguide flange with the arms directed above and below said abutting flanges and having a first means adapted to coact with the arms of said associated spring member for clamping said guides in abutment when said clamp assembly is moved towards said housing and to allow said guides to be separated when said clamp assembly is moved away from said housing.

2. The waveguide clamping apparatus according to claim 1 wherein said spring retainer clamp assembly comprises a first plate assembly having a flat front area and having an aperture for accommodating said rotatable threaded member, and having a second plate assembly having at least one slot along a side surface with said second plate assembly adapted to face said first plate assembly to form a spring accommodating cavity for accommodating the base of said U-shaped spring member and with said second plate assembly having an aperture aligned with said first plate aperture when said first and second plate assemblies are in contact.

3. The waveguide clamping apparatus according to claim 1 wherein said U-shaped spring member is characterized in having first and second extending arms directed from said base of said U on a right and left side, with each arm having a sloped distal portion at a given angle and sloping in the same direction to form an abutting surface for the back surface of said second waveguide flange.

4. The waveguide clamping apparatus according to claim 3 wherein said angle is between 15–20 degrees.

5. The waveguide clamping apparatus according to claim 4 where the top ends of said first and second spring member arms furthest remote from said base have extending projections.

6. The waveguide clamping apparatus according to claim 5 wherein said first means of the retainer clip are semicircular apertures adapted to receive said projections.

7. A waveguide clamping apparatus for clamping a first waveguide flange to a second waveguide flange, comprising:

a compression stop housing having an aperture adapted to receive a threaded rotatable member and having an end flange for coupling said housing to the back side of said first waveguide flange;

a spring retainer clamp assembly comprising a first plate section having a flat front area and having an aperture for accommodating a screw, a second plate section having an end slot directed along a side which slot abuts up against said first plate section to form a spring retaining cavity, with said second plate section having an aperture aligned with said aperture in said first plate section, both of which are aligned with said aperture in said compression stop housing;

a U-shaped spring assembly having the base of said U positioned in said cavity with the arms of said U extending outwardly along the back surface of said second waveguide flange when said first and second flanges abut;

an end spring retainer clamp also of a U-shaped configuration having the base arm coupled to the backside of said first waveguide flange with each arm of said U extending over said first and second waveguide flanges, and means located on each arm and operative to capture the arms of the spring assembly with a rotatable member directed through said apertures in said spring retainer clamp assembly and said compression stop housing and operative when rotated in a first direction to force said spring assembly against the back surface of said second waveguide flange to force and retain said flange in abutment with said first flange when the arms of the spring assembly are captured by said means and said rotatable member rotated in a second direction operative to release said spring assembly from said means.

8. The waveguide clamping apparatus acccording to claim 7 wherein said U-shaped spring assembly is characterized in having first and second extending arms directed from the base of said U on a right and a left side with each arm having a sloped distal portion at a given angle and sloping in the same direction to form an abutting surface for the back side of said second waveguide flange.

9. The waveguide clamping apparatus according to claim 8 wherein said angle is between 15–20 degrees.

10. The waveguide clamping apparatus according to claim 8 wherein the top ends of said first and second arms furthest remote from said base having extending projections.

11. The waveguide clamping apparatus according to claim 10 wherein said means located on said arms of said end spring retainer clamp are semicircular apertures adapted to receive said projections.

12. The waveguide clamping apparatus according to claim 7 wherein said compression stop housing has said aperture which is a threaded aperture to accommodate said rotatable member.

13. The waveguide clamping apparatus according to claim 7 wherein said rotatable member is a threaded bolt member.

14. The waveguide clamping apparatus according to claim 8 wherein said angle is 17 degrees.

15. A waveguide clamping apparatus for clamping first and second output waveguides each having a flange surrounding an output end and each extending parallel to one another and separated from one another by a given space, said clamping apparatus operative to clamp a first auxiliary waveguide having a peripheral flange to said first output waveguide and said clamping apparatus operative to clamp a second auxiliary waveguide having a peripheral flange to said second output waveguide comprising:

a compression stop housing located in said space having a left and a right flange, with said left flange coupled to the backside of said first output waveguide flange and with said right flange coupled to the backside of said second output waveguide flange, said housing extending between the flanges of said output waveguides and said auxiliary waveguides with a front wall of said housing parallel to said waveguide flanges and having a rotatable member accommodating aperture directed into said housing;

first and second U-shaped end spring retainer clips, with the base of said first clip secured to the back side of said first output waveguide at a side opposite said side coupled to said housing, with the base of said second clip secured to said housing, with the arms of said clips extending over the abutting flanges of said guides at a top and bottom position, said clips including spring retaining means on said arms;

a spring retainer assembly having a right and left spring accommodating slot and having a central aperture aligned with said aperture in said front wall of said compression stop housing;

a first U-shaped spring member having a base positioned in said right slot with the arms of the first spring member extending towards the backside of said flange of said first auxiliary waveguide, with a second U-shaped spring member having a base positioned in said left slot with the arms of the second spring member extending toward the backside of said second auxiliary waveguide flange with the ends of the arms having means for coacting with said spring retaining means on said U-shaped end spring retainer clips;

a rotatable member positioned in said aligned apertures and operative to move said retainer assembly towards or away from said housing with a clamped position by which the first and second spring members coact with the associated retainer clips to firmly push the flanges of the waveguides together and with an unclamped position by which the first and second spring members may be moved away from the retainer clips.

16. The waveguide clamping apparatus according to claim 15 wherein said first and second U-shaped spring members each having first and second extending arms directed from the base of said U on a right and a left side, with each arm having a sloped distal portion at a given angle and sloping in the same direction to form an area for coacting with the backside of the auxiliary waveguides.

17. The waveguide clamping apparatus according to claim 16 wherein said angle is between 15–20 degrees.

18. The waveguide clamping apparatus according to claim 15 wherein the ends of the arms of said first and second U-shaped spring members furthest remote from the base have extending projections.

19. The waveguide clamping apparatus according to claim 18 wherein said spring retaining means on said clips are partial apertures located on facing surfaces of said clips and positioned to accommodate said projections.

20. The waveguide clamping apparatus according to claim 15 wherein said rotatable member is a threaded bolt.

* * * * *